US008186119B1

(12) United States Patent
Huff et al.

(10) Patent No.: US 8,186,119 B1
(45) Date of Patent: May 29, 2012

(54) THERMAL ISOLATING HOUSING STRUCTURE

(75) Inventors: James Huff, Clio, MI (US); Zeke Carlyon, Vassar, MI (US)

(73) Assignee: MiTek Holdings, Inc., Wilmington, DE (US)

( * ) Notice: Subject to any disclaimer, the term of this patent is extended or adjusted under 35 U.S.C. 154(b) by 12 days.

(21) Appl. No.: 12/004,202

(22) Filed: Dec. 20, 2007

Related U.S. Application Data

(60) Provisional application No. 60/876,412, filed on Dec. 21, 2006.

(51) Int. Cl.
*F27D 1/00* (2006.01)

(52) U.S. Cl. ..... 52/506.03; 52/483.1; 52/302.3

(58) Field of Classification Search ..... 52/309.4, 52/506.06, 506.08, 208, 612, 782, 782.1, 52/782.23, 783.1, 404.4, 794.1, 79.1, 265, 52/268, 745.05, 800.11, 309.11, 483.1, 489.1, 52/302.3, 309.13, 309.14, 506.02, 506.03, 52/506.01; 296/186.1
See application file for complete search history.

(56) References Cited

U.S. PATENT DOCUMENTS

| | | | | | |
|---|---|---|---|---|---|
| 1,637,871 | A | | 8/1927 | Nosan | |
| 1,984,007 | A | | 12/1934 | Babbitt | |
| 2,039,601 | A | | 5/1936 | London | |
| 2,293,399 | A | | 8/1942 | Moecker, Jr. et al. | |
| 2,304,718 | A | | 12/1942 | Swart | |
| 2,327,585 | A | | 8/1943 | Ulrich | |
| 2,553,363 | A | * | 5/1951 | Droeger | 52/145 |
| 2,703,559 | A | * | 3/1955 | Godshalk | 122/6 A |
| 3,037,590 | A | | 6/1962 | Pavlecka | |
| 3,176,807 | A | | 4/1965 | Pavlecka | |
| 3,289,372 | A | * | 12/1966 | Adams et al. | 52/346 |
| 3,310,926 | A | * | 3/1967 | Brandreth et al. | 52/481.1 |
| 3,662,509 | A | * | 5/1972 | Studzinski | 52/404.1 |
| 3,670,466 | A | * | 6/1972 | Lynch | 52/211 |
| 4,014,150 | A | * | 3/1977 | Wells et al. | 52/461 |
| 4,223,505 | A | * | 9/1980 | Krebel et al. | 52/509 |
| 4,251,972 | A | * | 2/1981 | Interlante | 52/714 |
| 4,263,763 | A | * | 4/1981 | Bouwens | 52/404.3 |
| 4,274,239 | A | * | 6/1981 | Carroll | 52/443 |
| 4,311,460 | A | * | 1/1982 | Lauersdorf et al. | 432/247 |
| 4,346,543 | A | * | 8/1982 | Wilson et al. | 52/404.2 |
| 4,373,312 | A | * | 2/1983 | Kim | 52/309.9 |
| 4,434,592 | A | * | 3/1984 | Reneault et al. | 52/145 |
| 4,651,489 | A | * | 3/1987 | Hodges et al. | 52/409 |
| 4,686,803 | A | * | 8/1987 | Couderc et al. | 52/97 |
| 4,744,186 | A | * | 5/1988 | Smith et al. | 52/404.3 |
| 4,764,108 | A | * | 8/1988 | Carthew et al. | 432/128 |
| 5,036,638 | A | * | 8/1991 | Kurtz, Jr. | 52/284 |
| 5,379,561 | A | * | 1/1995 | Saito | 52/235 |
| 5,561,959 | A | * | 10/1996 | Alderman et al. | 52/407.3 |
| 5,724,784 | A | * | 3/1998 | Menchetti | 52/483.1 |
| 5,758,464 | A | * | 6/1998 | Hatton | 52/404.1 |
| 5,934,033 | A | * | 8/1999 | Matsuyama et al. | 52/235 |
| 6,074,206 | A | * | 6/2000 | Lauersdorf | 432/251 |
| 6,158,190 | A | * | 12/2000 | Seng | 52/841 |
| 6,289,646 | B1 | * | 9/2001 | Watanabe | 52/506.01 |

(Continued)

*Primary Examiner* — William Gilbert
*Assistant Examiner* — James Ference
(74) *Attorney, Agent, or Firm* — Senniger Powers LLP

(57) ABSTRACT

An improved wall structure for HVAC enclosures utilizing thermoplastic standoffs to form an air space and to separate the exterior wall structure of the enclosure from the interior wall structure. The position of the thermoplastic standoffs and the selection of the design for the standoffs insure that metallic fasteners would secure the exterior walls of the enclosure to the enclosure do not transmit thermal energy from the external wall to the internal wall.

17 Claims, 4 Drawing Sheets

U.S. PATENT DOCUMENTS

| | | | | |
|---|---|---|---|---|
| 6,345,511 | B1 | 2/2002 | Esty et al. | |
| 6,374,571 | B1 | 4/2002 | Mann | |
| 6,494,012 | B2 * | 12/2002 | Seng | 52/841 |
| 6,530,191 | B2 | 3/2003 | Rieke et al. | |
| 6,694,694 | B2 * | 2/2004 | Zeeff | 52/506.01 |
| 6,868,648 | B2 * | 3/2005 | Glover et al. | 52/786.1 |
| 6,923,493 | B2 | 8/2005 | Buchholz et al. | |
| 6,974,383 | B2 | 12/2005 | Lewis et al. | |
| 7,849,651 | B2 * | 12/2010 | Fujito et al. | 52/506.06 |
| 2001/0052205 | A1 * | 12/2001 | Herren | 52/93.1 |
| 2004/0055248 | A1 | 3/2004 | Grillos | |
| 2005/0055935 | A1 * | 3/2005 | Layfield | 52/506.01 |
| 2006/0026925 | A1 | 2/2006 | Layfield | |
| 2007/0261345 | A1 * | 11/2007 | Janka et al. | 52/404.1 |

* cited by examiner

THERMAL ISOLATING HOUSING STRUCTURE

PRIORITY CLAIM

This application claims the benefit of U.S. Provisional Application No. 60/876,412, filed Dec. 21, 2006.

FIELD OF THE INVENTION

The invention pertains to structures for housings for heating, ventilating and air conditioning equipment incorporating a thermally insulating construction.

BACKGROUND OF THE INVENTION

Commercial and industrial buildings frequently incorporate air-handling equipment for heating, ventilating and air conditioning purposes. In a typical HVAC application, movement of large quantities of air is facilitated by strong but lightweight enclosures which may house fans, motors, cooling elements, heating elements and/or humidifying elements. Because such enclosures are frequently roof-mounted, and because such enclosures gain utility by being portable, it is desirable that they be lightweight. At the same time, because the air-handling process typically involves creation of areas of high pressure or low pressure, it is desirable that HVAC enclosures feature relatively high strength in the walls, floors and tops.

Another important feature of this type of enclosure, in addition to the ability to withstand deformation under internal air pressures, is that such enclosures exhibit certain thermal insulating properties.

Enclosures of the type described are typically made of lightweight metals, such as aluminum, which has poor thermal insulating qualities. While aluminum has a high strength to weight ratio, in order to produce enclosures within optimum strength-to-weight ratios, relatively thin aluminum must be used. To enhance the strength of the enclosure using aluminum of this dimension, it is known to form the aluminum enclosure from aluminum sheets which are bent or otherwise formed to create essentially box-like panels of predetermined length, width and depth. Typically, the panel so formed is then filled with an insulating foam such as polyurethane. The resulting structure is a strong, lightweight building element, which can be cooperatively assembled with a collection of similar elements to form the walls, floor or ceiling of the enclosure.

In the prior art, the exterior surface of the completed enclosure is typically made of sheet aluminum, and is secured to the elements above-described. It is desirable, however, that this exterior surface be thermally insulated from the remaining elements of the closure. To accomplish this, prior art enclosures utilize a pair of aluminum extrusions which are joined together by a thermoplastic element having acceptable insulating qualities. In this fashion, the exposed exterior of the completed enclosure is thermally insulated from the interior of the enclosure. While this technique is useful, the design of the prior art structure includes placement of fasteners, bottom supports and top supports which allow transmission of heat energy from the interior to the exterior of the structure, hence reducing the insulating efficiency of the structure.

There is a need, therefore, for an improved wall structure for HVAC enclosures which minimizes the transmission of thermal energy from the interior to the exterior of the enclosure, while still maintaining the high strength and low weight of the completed enclosure.

SUMMARY OF THE INVENTION

The present invention, therefore, is an improved wall structure for HVAC enclosures utilizing thermoplastic standoffs to form an air space, and to separate the exterior wall structure of the enclosure from the interior wall structure. The position of the thermoplastic standoffs, and the selection of the design for the standoffs, insures that the metallic fasteners which secure the exterior walls of the enclosure to the enclosure do not transmit thermal energy from the external wall to the internal wall. Further, by positioning the outer wall of the enclosure away from the inner wall of the enclosure, a dead air space is created which enhances the thermal insulating properties of the completed structure. Finally, by using selected profiles for said thermoplastic standoffs, substantial versatility in the location and mounting of the standoffs is achieved.

DESCRIPTION OF ONE EMBODIMENT

Figure 1:
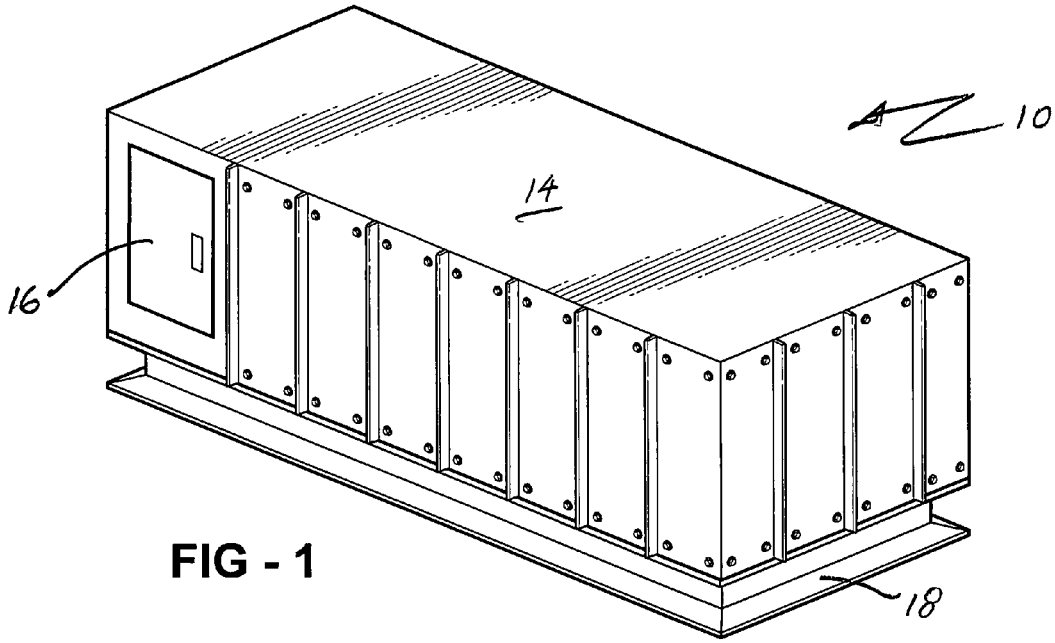
FIG. 1 is a first perspective view of the invention.
Figure 1A:
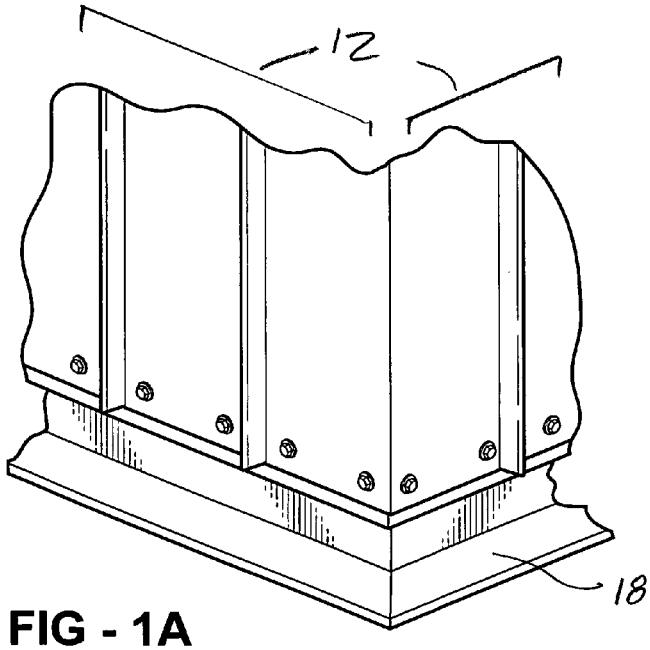
FIG. 1A is a second perspective enlarged view of a cutaway segment of the invention showing one corner including a pair of adjoining walls.

The details of the invention herein described will be best appreciated by reference to FIGS. 1 through 4 as above-described.

The invention comprises generally an enclosure 10, typically constructed of four wall sections 12, a floor section 13 and a top 14. These wall, floor and top sections create a six-sided enclosure 10, generally rectangular, into which are typically placed heating, ventilating and air conditioning components for providing heating and cooling to a residential or commercial structure with which the enclosure 10 may be associated. In order to provide access to the heating, ventilating and air conditioning mechanics, an access door 16 is typically provided. The entire enclosure 10 is mounted to a base 18 typically comprised of lightweight yet sturdy material which acts as the load-carrying element for the enclosure 10.

To minimize heating and cooling losses, it is preferable that the structure of enclosure 10 be efficiently insulated. Achievement of this goal is accomplished through the unique combination and positioning of thermal insulating materials and an adjoining dead air space. This functionality will be best understood by initial reference to FIG. 2, which depicts an interior corner of the enclosure 10, absent the enclosure top 14 to facilitate visualization of the various components and their interrelation.

The interior portion of the enclosure 10, including the walls, floor and top are constructed from a plurality of frame members or shaped elements 20 which are constructed as discrete components, and then assembled together to form the walls, floor and top of the enclosure 10. Each shaped element is preferably formed of high strength, ductile sheet aluminum, and can be integrally-formed. To form an individual shaped element 20, the sheet aluminum is folded to form an inner wall 22, a pair of opposed top and bottom caps 24, and a pair of opposed end walls 26. The distal ends of the end walls 26 are then folded again to position parallel to the inner wall, creating a pair of longitudinally extending mounting surfaces or outer flanges 28, each having a longitudinal axis that extends substantially vertically. The result of this fabrication step is the formation of a five-sided sub-enclosure with a partially opened sixth side providing access to a cavity 32 contained within the enclosure. The cavity 32 may then be filled with insulating material 30 such as polyurethane, self-curing foams or fiberglass batting. The shaped elements 20 may be of any of a variety of dimensions in thickness, length, and width. In the illustrated embodiment, the shaped elements are substantially rectangular. The dimensions for each shaped element 20 are determined based on the desired finished dimension of the enclosure 10. Each shaped element is comparable to a 2×6, 2×8, 2×10, etc. board, such as may be used in conventional wood frame construction. However, because the shaped elements 20 are constructed of formed aluminum frames, they exhibit very high strength and low weight characteristics, which, when coupled with the addition of insulation as above-described, results in a structural element which is lightweight, versatile, and which has excellent thermal insulating properties.

Figure 2:
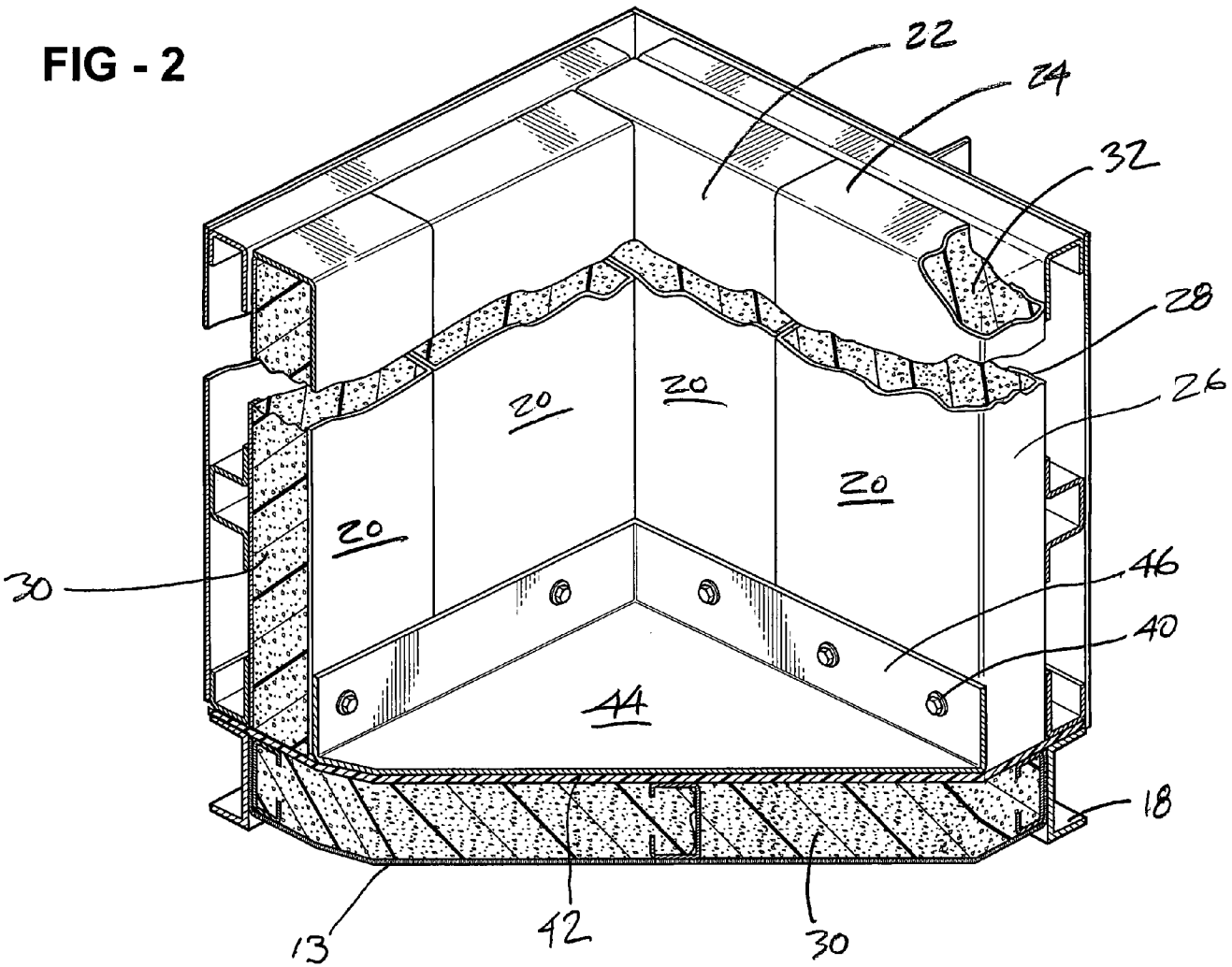
FIG. 2 is a third perspective view of an interior corner of the invention showing various cutaway sections.

As shown in FIG. 2, a plurality of these shaped elements may be placed in adjoining positions, and constitute the building blocks from which the floor, walls and top of enclosure 10 are ultimately constructed. To hold the shaped elements 20 together, and to join the floor section 13, wall sections and top sections together, the shaped elements 20 may be secured together with fasteners, adhesives, or by welding.

In a typical embodiment, the shaped elements making up the floor section 13 are secured to base 18 utilizing fasteners 40, welding or adhesives. Base 18 is preferably in the form of a C-channel of high strength aluminum, having sufficient strength to bear the weight loads of the elements of enclosure 10, as well as to provide a base by which the enclosure 10 may be secured to a portion of the structure with which the enclosure is associated. In the preferred embodiment, a thermoplastic insulator 42 is placed on top of the floor section 13, and the shaped elements 20 making up the floor section 13, are filled with insulating material 30 as above-described. A floor covering plate 44 is placed over the insulator 42. Floor covering plate 44 is provided with upstanding flashings 46 to which the shaped elements 20 forming the walls of the enclosure may be secured by fasteners 40. As with the other components of the enclosure, floor covering plate 44 with flashings 46 is preferably formed of high strength ductile aluminum sheeting to facilitate fabrication and to provide the necessary strength for the structure. Typically, floor covering 44 is provided with a non-skid surface to provide secure footing for workers accessing the interior of the enclosure 10. Each shaped element 20 utilized for the wall structure is filled with insulating material 30, which may be in the form of polyurethane foam, fiberglass batting or comparable insulating materials. As a result, each shaped element 20 provides excellent insulating properties between the inner wall and outer flanges thereof.

To further enhance the insulating properties of the enclosure 10, affixed to the outer flanges 28 of shaped elements 20 are a plurality of thermoplastic channels. Thermoplastic is selected as the material of choice for these channels because of its excellent thermal insulating qualities. Either polyurethane, fiberglass reinforced plastics, or acrylics may be utilized.

Figure 3:
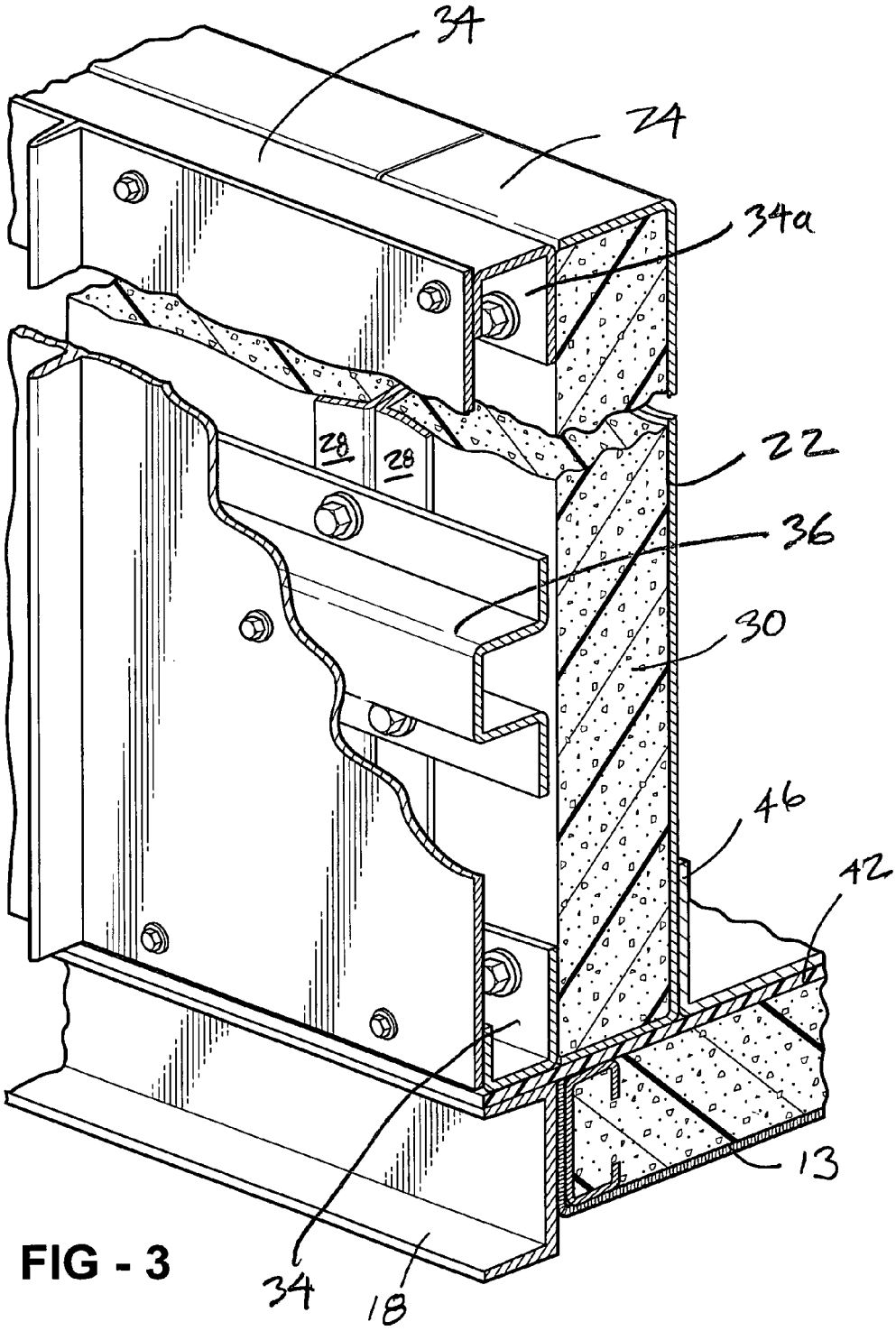
FIG. 3 is a detailed perspective cutaway view of a typical floor section and wall section of the invention.
Figure 4:
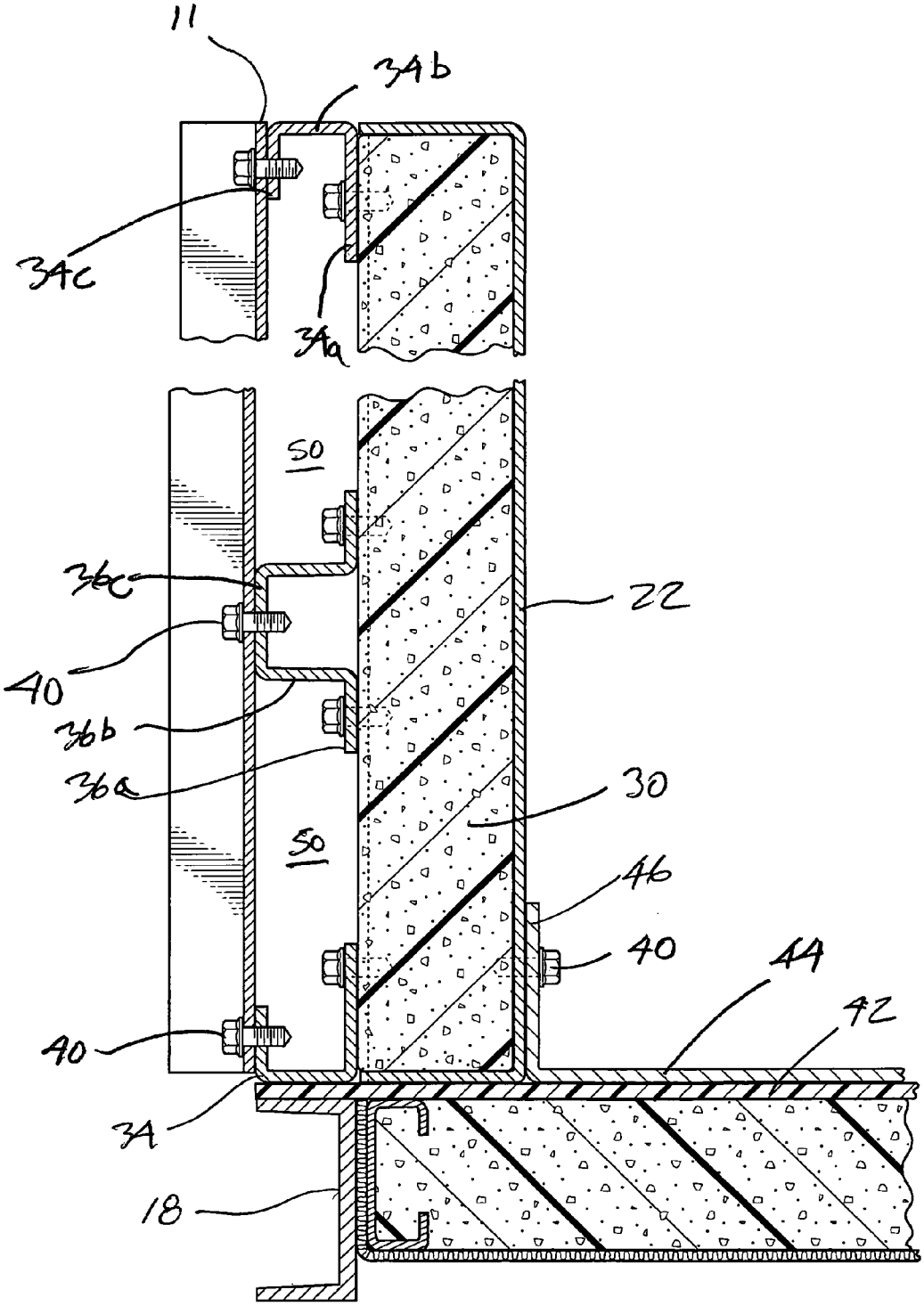
FIG. 4 is a cross-sectional view showing the structure of the side wall and floor.

The positioning of the channels will be best appreciated with reference to FIGS. 3 and 4. Affixed near the top and bottom of the shaped elements 20 which form the wall sections of the enclosure 10 are a pair of opposed J-channels 34. Each J-channel 34 has an upright 34*a*, a foot 34*b* and a toe 34*c*. In a preferred embodiment, the upright portion of the J-channel is secured to the outer flanges 28 of the shaped elements 20. Typically, the J-channels 34 are attached utilizing fasteners 40, which are preferably of the hex head, self-tapping, self-threading type well known in the art. The use of this type of fastener facilitates speed of assembly of the completed structure. As best seen in FIG. 4, the fasteners 40 do not extend through the inner wall 22 of the shaped element. The enclosure 10 is provided with an outer wall 11, typically constructed of sheet aluminum, and formed with a plurality of ribs 15 which provide strength to the exterior wall 11. The outer wall of the enclosure 10 is secured to the toes of the J channels using similar fasteners. As depicted in FIG. 4, it will be appreciated that the upper and lower J-channels 34 are specifically positioned and oriented so as to maximize the airspace 50, and to form closures for that airspace. Further, it will be appreciated that the foot 34*b* of J-channel 34 is oriented so as to bring the foot 34*b* into contact with insulator 42.

Between the upper and lower J-channels 34 are positioned a plurality of hat channels 36. Each hat channel has a pair of opposed brim sections 36*a*, a pair of upright sections 36*b* and a peak section 36*c*. In the invention, the brim sections of the hat channel 36 are secured to the outer flanges of shaped elements 20 utilizing hex head, self-tapping, self-threading fasteners 40 as shown in FIGS. 3 and 4. The outer wall 11 of enclosure 10 is then secured to the peaks 36*c* of the hat sections 36 using similar threaded fasteners.

Although not depicted, the top of the enclosure 10 may be constructed in a similar fashion. The resulting enclosure therefore features an airspace 50 disposed between the outer wall 11 and the outer flanges 28 of the shaped elements 20. This airspace 50 imparts desirable insulating properties to the completed structure.

It will be appreciated by reference to FIG. 4 that the use of the J-channels 34 and hat channels 36 herein described results in enhanced thermal isolation properties for the completed structure. Since there is no metal to metal contact between the outer wall 11 of the enclosure 10 and the shaped elements 20 which form the interior walls and ceiling of the enclosure, no thermal energy is transmitted from the inner walls and floor covering of the enclosure to the outer wall of the enclosure. The use of J-channels 34 at the outer edges of the wall sections serves to maximize the volume of the airspace between the outer wall 11 and the wall sections constructed of shaped elements 20. Placement of the J-channels in contact with the floor insulator 42 prevents transfer of thermal energy from outer wall 11 to floor section 13.

We claim:

1. An improved wall construction for an air handling enclosure, comprising:

a frame member having an inner wall and a mounting surface that is spaced from said inner wall, said frame member defining a cavity thereon, and said frame member having sufficient thickness such that said frame member is self supporting and adapted to serve as a primary load bearing structure of the air handling enclosure;

a non-structural insulating material disposed within said cavity of said frame member;

a metallic sheet parallel to and spaced from said mounting surface, thereby defining an air gap between said frame member and said metallic sheet; and a plurality of elongate rails having at least a first mounting flange having a first end and a second end, a second mounting flange having a first end and a second end, and a base portion having a first end and a second end, wherein said first mounting flange is in opposed, face-to-face relation with said mounting surface and connected to said mounting surface, and said second mounting flange is spaced from the mounting surface of the frame member and in opposed, face-to-face relation with said mounting surface and is connected to said metallic sheet, and wherein said first mounting flange and said second mounting flange each extend in the same direction from opposite ends of the base portion of the elongate rail.

2. The improved wall construction for an air handling enclosure stated in claim 1, further comprising:

said frame member having a peripheral wall for spacing said inner wall from said at least one mounting surface, said peripheral wall cooperating with said inner wall to define said cavity.

3. The improved wall construction for an air handling enclosure stated in claim 2, further comprising:

said inner wall, said peripheral wall, and said at least one mounting surface of said frame member are formed integrally.

4. The improved wall construction for an air handling enclosure stated in claim 1, further comprising:

said plurality of elongate rails fabricated from a material having a low thermal conductivity.

5. The improved wall construction for an air handling enclosure stated in claim 1, further comprising:

said plurality of elongate rails fabricated from plastic.

6. The improved wall construction for an air handling enclosure stated in claim 1, further comprising:

said plurality of elongate rails fabricated from thermoplastic.

7. The improved wall construction stated in claim 1, wherein said mounting surface of said frame member has a width and a height greater than the width, and each of said elongate rails has a width, a height, and a length greater than both of the width and the height, the height of the mounting surface extending substantially perpendicular to the length of each of said elongate rails.

8. The improved wall construction stated in claim 1, wherein said mounting surface of said frame member has a longest dimension and an axis along the length of the longest dimension that extends vertically, and each of said elongate rails has a longest dimension and an axis along the length of the longest dimension that extends horizontally.

9. The improved wall construction stated in claim 1, wherein said insulating material is fiberglass batting.

10. The improved wall construction for an air handling enclosure stated in claim 1, further comprising:

a first plurality of fasteners for connecting said first mounting flanges of said plurality of elongate rails to said at least one mounting surface of said frame, wherein none of the first plurality of fasteners extends through the inner wall of the frame member; and a second plurality of fasteners for connecting said second mounting flanges of said plurality of elongate rails to said metallic sheet.

11. An improved wall construction for an air handling enclosure, comprising:

a frame member having an inner wall and a pair of laterally spaced, longitudinally extending mounting surfaces, wherein said mounting surfaces are spaced from said inner wall;

an insulating material disposed within said frame member;

a metallic sheet parallel to and spaced from said mounting surfaces, thereby defining an air gap between said frame member and said metallic sheet;

a plurality of elongate rails each formed from a non-metallic material having a low thermal conductivity, each said rail having at least a first mounting flange and a second mounting flange wherein said first mounting flange is connected to both of said mounting surfaces at spaced locations along said mounting flange, and said second mounting flange is connected to said metallic sheet to provide a thermal break between the frame member and the metallic sheet, and wherein said plurality of elongate rails each have a J-shaped cross-section including an upright section having a first major surface and a second major surface, a foot section, and a toe section having a first major surface and a second major surface, said upright section and said toe section being in opposing, face-to-face relation with each other, such that the first major surface of the upright section is adjacent to both of said mounting surfaces and the second major surface of the upright section is in opposing, face-to-face relation with the first major surface of the toe section, the second major surface of the toe section being adjacent to the metallic sheet such that the toe section engages and is directly connected to the metallic sheet.

12. The improved wall construction stated in claim 11, wherein said plurality of J-shaped rails are disposed by attachment of said upright section to said mounting surface wherein said foot section is adjacent and coplanar to a top wall of said frame member, and said toe section is secured to said metallic sheet.

13. The improved wall construction stated in claim 11, wherein each of said mounting surfaces of said frame member has a width and a height greater than the width, wherein a longitudinal axis that extends along the height is substantially perpendicular to a longest dimension of said elongate rails.

14. The improved wall construction stated in claim 11, wherein each of said mounting surfaces of said frame member has a width and a height greater than the width, wherein a longitudinal axis that extends along the height extends vertically, and each of said elongate rails has a longest dimension extending orthogonal to the height of each of the mounting surfaces and parallel to the width of each of the mounting surfaces, wherein a longitudinal axis that extends along the longest dimension extends horizontally.

15. An improved wall construction for an air handling enclosure, comprising:

a plurality of integrally-formed, substantially rectangular frame members each having an inner wall, a top wall, a bottom wall, a pair of end walls, and a pair of laterally spaced, longitudinally extending mounting surfaces each having a width and a height greater than the width, said top wall, said bottom wall and said end walls extending substantially perpendicular to said inner wall, and said mounting surfaces connected to said end walls, extending substantially parallel to said inner wall and spaced from said inner wall by said end walls, the inner wall, the top wall, the bottom walls, and the end walls cooperating to define a cavity within each said frame member, wherein said rectangular frame members are positioned in a side-by-side manner with respect to one another such that one of said end walls of adjacent pairs of said frame members are in contact with one another;

a non-structural insulating material disposed within said cavity of each said frame member;

a metallic sheet parallel to and spaced from said mounting surfaces, thereby defining an air gap between said frame member and said metallic sheet; and a plurality of elongate rails each formed from a non-metallic material having a low thermal conductivity, said rails extending substantially perpendicular to an axis extending along the height of said mounting surfaces of said frame members, each said rail having at least a first mounting flange and a second mounting flange wherein said first mounting flange is connected to both said mounting surfaces of at least two frame members of said plurality of frame members, and said second mounting flange is connected to said metallic sheet to provide a thermal break between the frame member and the metallic sheet; and wherein the height of each of said mounting surfaces extends vertically, and each of said elongate rails has a longest dimension that extends horizontally.

16. The improved wall construction stated in claim 15, wherein said frame members are fabricated from aluminum having sufficient thickness such that said frame members are self supporting and adapted to serve as primary load bearing structures of the air handling enclosure.

17. An improved wall construction for an air handling enclosure comprising:

a frame member having an inner wall and a pair of laterally spaced, longitudinally extending mounting surfaces, wherein said mounting surfaces are spaced from said inner wall, and wherein each of said mounting surfaces has a longitudinal axis that extends vertically;

a solid insulating material disposed within said frame member;

a metallic sheet parallel to and spaced from said mounting surfaces, thereby defining an air gap between said frame member and said metallic sheet;

a first elongate rail having a J-shaped cross-section including a foot section adjacent and coplanar to a top wall of said frame member, an upright section extending orthogonally from an end of the foot section, the upright section connected to both of said mounting surfaces, and a toe section extending orthogonally from an opposite end of the foot section in the same direction as the upright section, the toe section connected to said metallic sheet, wherein a longitudinal axis extending along a longest dimension of the first elongate rail extends horizontally;

a second elongate rail having a J-shaped cross-section including a foot section adjacent and coplanar to a bottom wall of said frame member, an upright section extending orthogonally from an end of the foot section, the upright section connected to both of said mounting surfaces, and a toe section extending orthogonally from an opposite end of the foot section in the same direction as the upright section, the toe section connected to said metallic sheet, wherein a longitudinal axis extending along a longest dimension of the second elongate rail extends horizontally; and a plurality of intermediate elongate rails vertically spaced between said first and second elongate rails, the intermediate elongate rails each having a hat-shaped cross-section including a pair of opposed brim sections connected to both of said mounting surfaces, a peak section connected to said metallic sheet, and a pair of opposed upright sections spacing said brim sections and said peak section, wherein a longitudinal axis extending along a longest dimension of each of said intermediate elongate rails extends horizontally.

* * * * *